US009077113B2

(12) United States Patent
Chastanet

(10) Patent No.: US 9,077,113 B2
(45) Date of Patent: Jul. 7, 2015

(54) PRESS-INSERTION CONNECTOR

(75) Inventor: Jerome Chastanet, Toulouse (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 14 days.

(21) Appl. No.: 14/003,519

(22) PCT Filed: Mar. 30, 2012

(86) PCT No.: PCT/EP2012/001409
§ 371 (c)(1),
(2), (4) Date: Sep. 6, 2013

(87) PCT Pub. No.: WO2012/143086
PCT Pub. Date: Oct. 26, 2012

(65) Prior Publication Data

US 2013/0344744 A1 Dec. 26, 2013

(30) Foreign Application Priority Data

Apr. 22, 2011 (FR) ..... 11 01273

(51) Int. Cl.
*H01R 12/00* (2006.01)
*H01R 13/64* (2006.01)
*H01R 12/72* (2011.01)

(52) U.S. Cl.
CPC ..... *H01R 13/64* (2013.01); *H01R 12/724* (2013.01)

(58) Field of Classification Search
CPC ..... H01R 23/7073; H01R 23/7026
USPC ..... 439/79–83, 567
See application file for complete search history.

(56) References Cited

U.S. PATENT DOCUMENTS 7,086,873 B2 * 8/2006 Nose et al. ..... 439/79
2004/0115971 A1 6/2004 Nose et al.

FOREIGN PATENT DOCUMENTS

DE 20 2005 014070 U1 11/2005
EP 1 942 559 A1 7/2008
JP 9 069371 A 3/1997
WO 2008/058464 A1 5/2008

OTHER PUBLICATIONS

International Search Report, dated Jul. 9, 2012, from corresponding PCT application.

* cited by examiner

*Primary Examiner* — Phuongchi T Nguyen
(74) *Attorney, Agent, or Firm* — Young & Thompson

(57) ABSTRACT

A connector includes:
a casing (1),
a plurality of pins (2), including:
a first end portion (3), extending along a first axis (A1),
a second end portion (4), extending along a second axis (A2),
a securing portion (5), adjacent to the first end portion (3) and secured to the casing (1),
an insertion part (6), arranged between the securing portion (5) and the second end portion (4),
certain pins (2) including at the level of their insertion part (6) at least one wavy inflected part (7) including at least one axial part (11) extending along the first axis (A1) or the second axis (A2) and an off-axis part (12) extending radially distant from the axial part (11), the off-axis part (12) being connected to the axial part (11) through a curved shape.

5 Claims, 5 Drawing Sheets

PRESS-INSERTION CONNECTOR

BACKGROUND OF THE INVENTION

1. Field of the Invention

The present invention relates in a general manner to a press-insertion connector, commonly referred to as a press-fit connector, and more specifically to a press-fit connector adapted to connect a printed circuit to an electrical device.

2. Description of the Related Art

Press-insertion connectors, known as press-fit connectors, are already known from the prior art. These connectors are commonly used to make connections on the printed circuit without soldering.

With reference to FIG. 1 in the appended drawings, the connector according to the prior art comprises a casing 1 and a plurality of pins 2.

The connector may also comprise an alignment grid 13.

The pins 2 are attached to the casing 1 and are arranged in a number of rows. A number of pins 2 are aligned on each row.

Usually, the connector may comprise 50 to 200 pins arranged in 3 to 5 rows. In the connectors of the latest generation, the number of pins 2 tends to be much greater than that of the usual connectors, while their dimensions remain substantially identical.

At the time of the connection of the connector to the printed circuit, the pins 2 are inserted into the corresponding holes of the printed circuit in a direction of insertion 16 that is substantially perpendicular to the plane of the printed circuit.

One of the difficulties encountered at the time of manufacture of connectors of the press-fit type lies in the positioning of the pins. The higher the density of the pins, the more important this problem becomes.

In the first instance, the pins must be correctly positioned according to the length and across the width of the connector, the width and the length of the connector being defined in a plane parallel to the plane of the printed circuit.

In fact, at the time of the insertion by pressure of the pins of the connector into the holes in the printed circuit, each pin must be perfectly positioned in relation to the hole into which it must be inserted. Every incorrectly positioned pin would not penetrate into the corresponding hole and would cause a malfunction.

In addition to the positioning of the pins according to the width and to the length, it is also necessary to ensure the good positioning of the pins according to the height, the height being defined according to the direction of insertion 16.

In fact, the extremities of the pins that are intended to be inserted by pressure into a hole in the printed circuit must be positioned in one and the same plane otherwise there is a risk of their becoming jammed in the tool which assures their insertion into the printed circuit. In addition, they run the risk of not finding the hole into which they must be inserted and of being crushed on the printed circuit.

Whereas the incorrect positioning of the pins according to the width and to the length is corrected in particular by means of an alignment grid, no satisfactory solutions are available for correcting the length of the pins according to the direction of insertion 16.

BRIEF SUMMARY OF THE INVENTION

The invention aims to eliminate, or at least to reduce, all or part of the aforementioned disadvantages of the prior art.

For this purpose, a first aspect of the invention proposes a connector comprising:

a casing and a plurality of pins, each pin comprising:

- a first end portion, extending along a first axis,
- a second end portion, extending along a second axis,
- a securing portion, adjacent to the first end portion and secured to the casing,
- an insertion part, arranged between the securing portion and the second end portion;

certain pins comprising at the level of their insertion part at least one wavy inflected part, as a result of which the extremities of the second end portions of the pins are situated substantially in one and the same plane perpendicular to the second axis.

Thanks to these arrangements, the wavy inflected part makes it possible to reduce, on the second axis, the length of the insertion part on which it is situated and consequently the length of the corresponding pin.

Thus, the length of each pin, on the second axis, may be adjusted in such a way that the second end portions of the pins are situated in the same plane perpendicular to the second axis.

In various embodiments of the invention, it is possible to have recourse, if required, to one or other of the arrangements described below.

According to a first embodiment, the insertion part of each pin comprises:

- a first straight portion adjacent to the securing portion and extending essentially on the first axis,
- a second straight portion adjacent to the second end portion and extending essentially on the second axis,
- a bent portion, situated between the first and the second straight portion.

The expressions "extending essentially on an axis" or "essentially straight" are used, in particular, to denote "extending on an axis" or "straight" with the exception of the inflected parts and/or a possible shoulder.

The connector according to this first embodiment is a connector known as an angle connector.

The presence of an inflected part on certain pins makes it possible to adjust the length of the pins on the second axis in the case of an angle connector.

Preferably, the first axis is substantially perpendicular to the second axis.

This is thus a connector known as a right-angle connector.

According to a first variant of the first embodiment, certain pins comprise at least one wavy inflected part at the level of their first straight portion.

The inflected part may thus be realized on pins on which the second straight portion is too short for an inflected part, in particular, to be realized there for the shortest pins of the connector.

According to a second variant of the first embodiment, certain pins comprise at least one wavy inflected part at the level of their second straight portion.

The inflected part is thus closer to the second end portion, enabling its position to be adjusted more effectively in relation to the plane perpendicular to the second axis.

According to another variant of the first embodiment, certain pins comprise at least one wavy inflected part at the level of their bent portion.

According to a second embodiment, the insertion part of each pin extends essentially on the second axis, the first and second axes being colinear.

This is thus a connector of the straight connector type.

The presence of inflected parts at the level of certain pins permits the length of the pins to be adjusted on their second axis in the case of a straight connector.

According to one or other of the embodiments, the wavy inflected part may comprise at least one axial part extending along the first axis or the second axis and an off-axis part extending radially distant from the axial part, the off-axis part being connected to the axial part through a curved shape.

In a second aspect, the invention also relates to a method for the manufacture of a connector comprising at least the following steps:

a/ supplying a plurality of pins, each pin comprising:

a first end portion, and a second end portion, b/ attaching the pins to a casing, each pin being attached at the level of a securing portion, adjacent to the first end portion, the portion of the pin between the securing portion and the second end portion defining an insertion part; the method comprises in addition a step consisting of:

c/ realizing on certain pins at least one wavy inflected part at the level of their insertion part.

Such a method of manufacture permits the length of the insertion part to be reduced. By adjusting the length of the pins in this way, the method allows a connector to be obtained, of which the extremities of the second end portions of the pins are situated substantially in one and the same plane.

According to one embodiment of the method according to the invention, the pins are integral with the casing in such a way that the insertion parts of the pins extend in one and the same direction, referred to as the direction of connection, and the method according to the invention in addition comprises a step which involves bending the pins at the level of their insertion part in a direction perpendicular to the direction of connection.

The method according to the invention enables the manufacture of right-angle type connectors.

According to one embodiment of the method according to the invention, the step of realizing at least one wavy inflected part on certain pins precedes the bending step.

In order to facilitate the connectors manufacture and, in particular, its automation, the step involving the realization of at least one wavy inflected part takes place before the bending. Access to the different parts of the pins is thus easier.

BRIEF DESCRIPTION OF THE DRAWINGS

Other characteristics and advantages of the invention can be appreciated from reading the following description. This is purely illustrative and must be read in the light of the accompanying drawings, in which.

The same references designate identical or similar elements in the different figures.

DETAILED DESCRIPTION OF THE PREFERRED EMBODIMENTS

Figure 1:
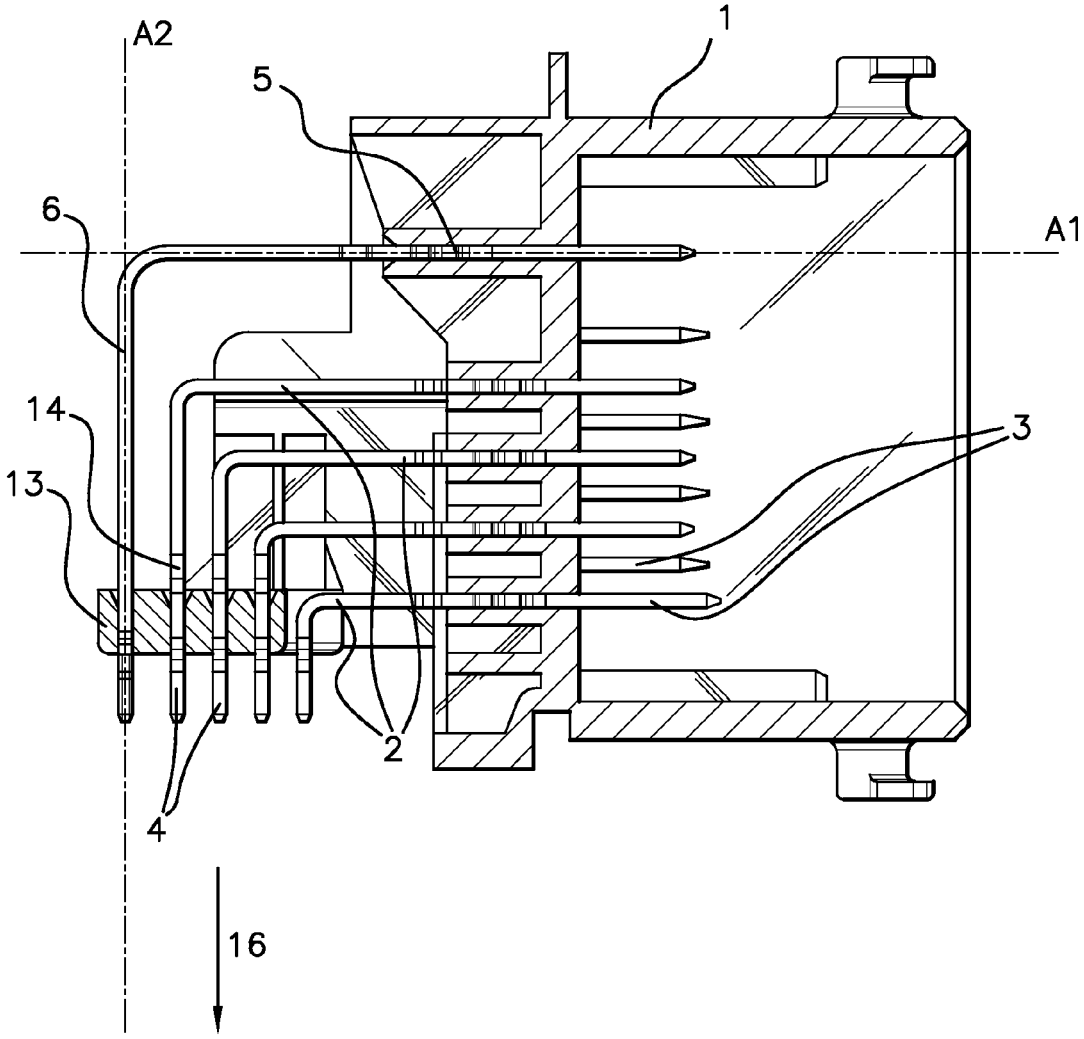
FIG. 1, already analyzed, is a sectional view of a connector according to the prior art.
Figure 2:
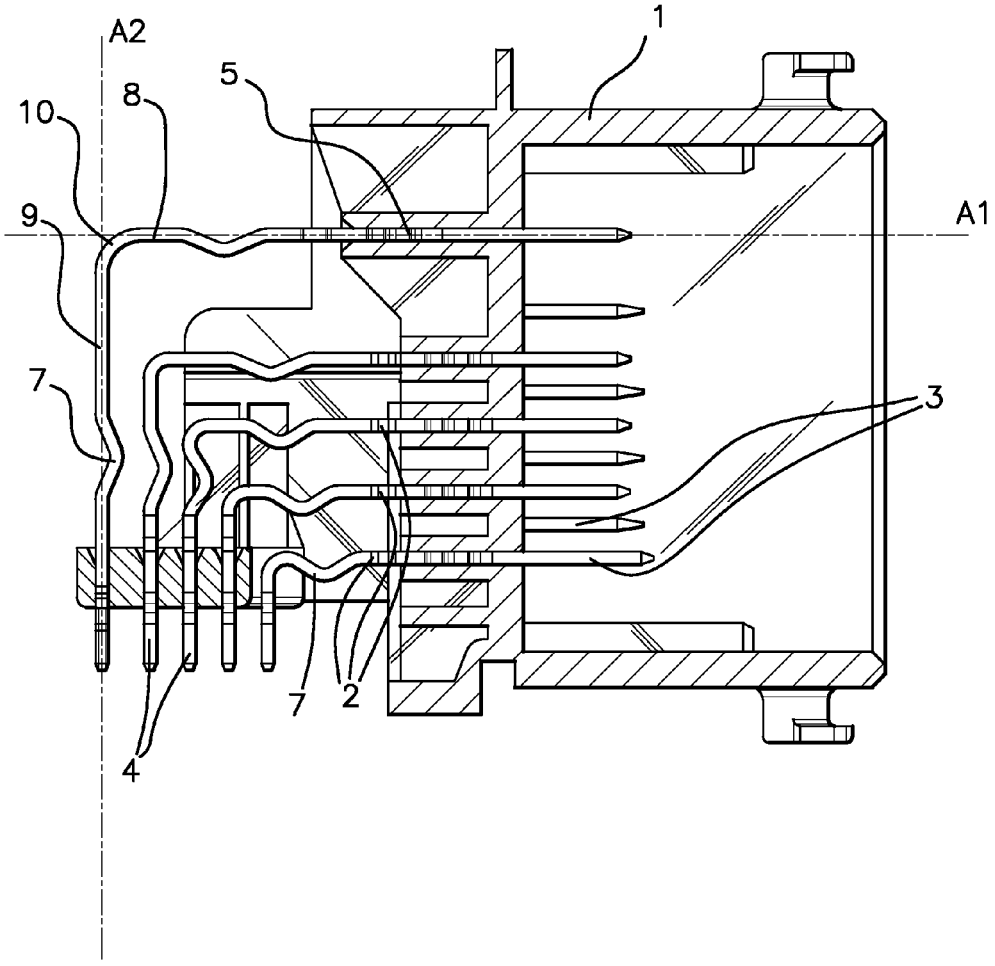
FIG. 2 is a sectional view of a connector according to a first embodiment of the invention.

FIG. 2 shows a connector according to the invention. This connector is a press-insertion connector adapted to connect a printed circuit to an electrical device.

It comprises a casing 1 and a plurality of pins 2.

The casing 1 is constituted by an isolating material, generally plastic. It preferably consists of a single piece.

The plurality of pins 2 is arranged in the casing 1 and is securely attached to the latter.

The pins 2 are arranged in a number of rows. A number of pins 2 are aligned on each row.

The pins 2 may be of square, round or hexagonal cross section.

Each pin 2 comprises a first end portion 3 and a second end portion 4.

The first end portion 3 is adapted to be connected to an electrical device. This first end portion 3 extends on a first axis A1, also referred to as the axis of connection.

The second end portion 4, on the other hand, is adapted to be inserted by pressure into a hole in the printed circuit. It extends on a second axis A2, also referred to as the axis of insertion.

The axis of insertion A2 is perpendicular to the printed circuit plane into which the connector is intended to be inserted. At the time of insertion of the second end portion 4 of the connector into the holes in the printed circuit, a pressure is exerted perpendicularly to the plane of the printed circuit via an assembly device and accordingly in a direction parallel to the axis of insertion A2.

Each pin 2 is kept secured to the casing 1 at the level of a securing portion 5, adjacent to the first end portion 3.

The securing portion 5 extends in the axis of connection A1.

Each pin 2 comprises in addition an insertion part 6 situated between the securing portion 5 and the second end portion 4.

The insertion part 6 may comprise a shoulder 14 adapted to receive the pressure exerted by the assembly device at the time of insertion of the connector second end portion 4 into the holes of the printed circuit.

According to a first embodiment represented in FIG. 2, the connector is an angle connector.

The insertion part 6 of each pin 2 thus comprises two essentially straight, non-aligned portions 8 and 9.

The insertion part 6 of each pin 2 comprises a first straight portion 8, which is adjacent to the securing portion 5 and which extends essentially in the axis of connection A1. The first end portion 3, the securing portion 5 and the first straight portion 8 thus extend, all three, essentially in the axis of connection A1.

The second straight portion 9 of the insertion part 6, on the other hand, is adjacent to the second end portion 4 and extends essentially in the axis of insertion A2.

A bent portion 10 situated between the first 8 and the second 9 straight portions assures the transition between these two straight portions.

As represented in FIG. 2, according to a preferred embodiment, the axis of connection A1 is substantially perpendicular to the axis of insertion A2; the connector in this case is a right-angle connector.

Typically, the axis of connection A1 is parallel to the printed circuit plane into which the connector is intended to be inserted, and the axis of insertion A2 is perpendicular to this plane.

As represented in FIG. 2, certain pins 2 comprise at least one wavy inflected part 7 at the level of their insertion part 6.

The wavy inflected part 7 comprises at least one axial part 11 (cf. FIGS. 3 and 4), extending along the axis of connection A1 or the axis of insertion A2 and an off-axis part 12 extending radially distant from the axial part 11, the off-axis part 12 connecting to the axial part 11 through a curved shape.

The wavy inflected part 7 is of the same diameter as the parts which are adjacent to it.

The form of a wave may be a form substantially in the arc of a circle or in the arc of an oval.

If the pins comprise a shoulder 14, the wavy inflected part 7 is situated at the level of the insertion part 6 between the securing portion 5 and said shoulder 14.

The pin 2 being integral with casing 1 at the level of the securing portion 5, the presence a wavy inflected part 7 at the level of the insertion part 6 permits the length of the insertion part 6 to be reduced in the axis of insertion A2.

The dimensions of the wavy inflected part 7 are determined by mathematical modeling as a function of the reduction of the desired length.

The extent to which their length in the axis of insertion A2 must be reduced—if Necessary—is determined for each pin 2, in order for the extremities of the second end portions 4 of the pins 2 to be situated substantially in the same plane perpendicular to the axis of insertion A2.

Once the differential in the length has been determined, a simple mathematical model makes it possible to determine the dimensions of the wavy inflected parts 7.

Figure 7:
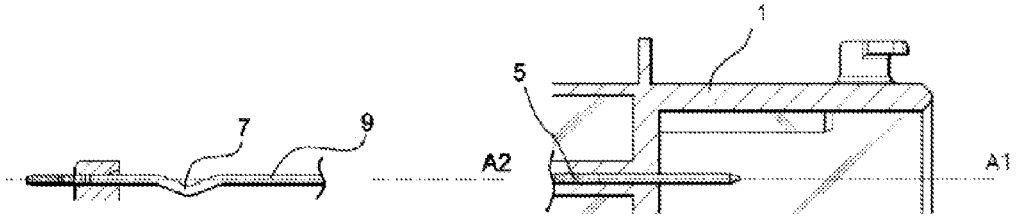
FIG. 7 is a sectional view of a connector according to a second embodiment of the invention.

According to a second embodiment (FIG. 7) the connector is a straight connector. The insertion part 6 of each pin extends essentially in the axis of insertion A2. The first axis A1 and second axis A2 are colinear.

Figure 3:
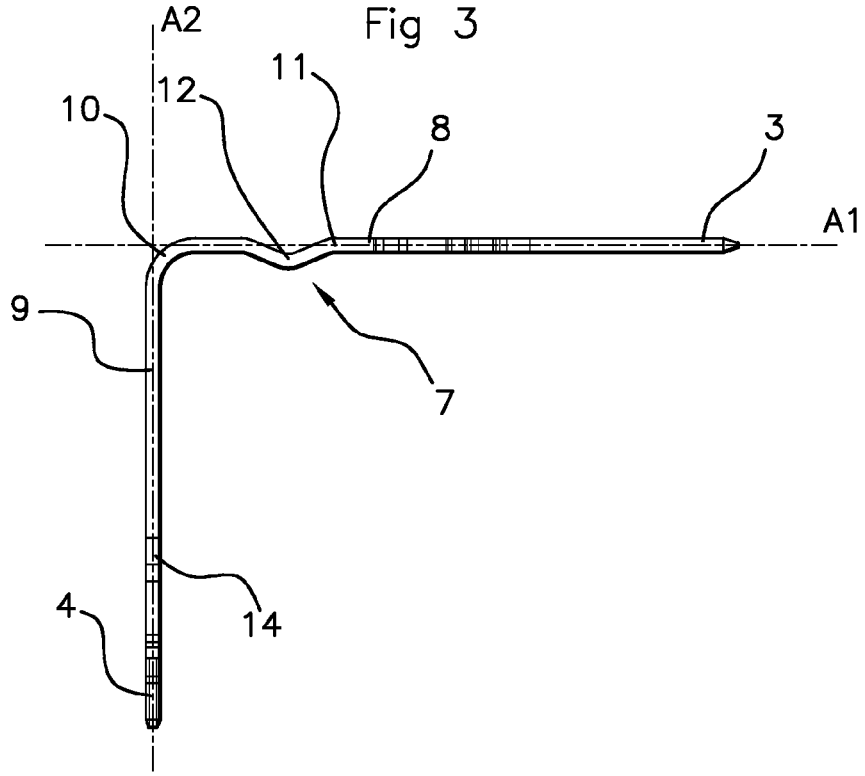
FIG. 3 represents a pin according to a first variant of the first embodiment of the invention.

According to a first variant of the first embodiment represented in FIG. 3, certain pins 2 comprise one wavy inflected part 7 at the level of their first straight portion 3.

According to this variant, the off-axis part 12 of the wavy inflected part 7 extends radially distant from the first axis A1.

The off-axis parts 12 at the level of a first straight portion 8 in their entirety preferably extend radially in the same direction, making it possible to reduce the risk of two wavy inflected parts 7 situated on adjacent pins coming into contact.

Likewise, the off-axis part 12 will not extend radially at a distance from the axis such that it enters into contact with an adjacent pin 2.

Figure 4:
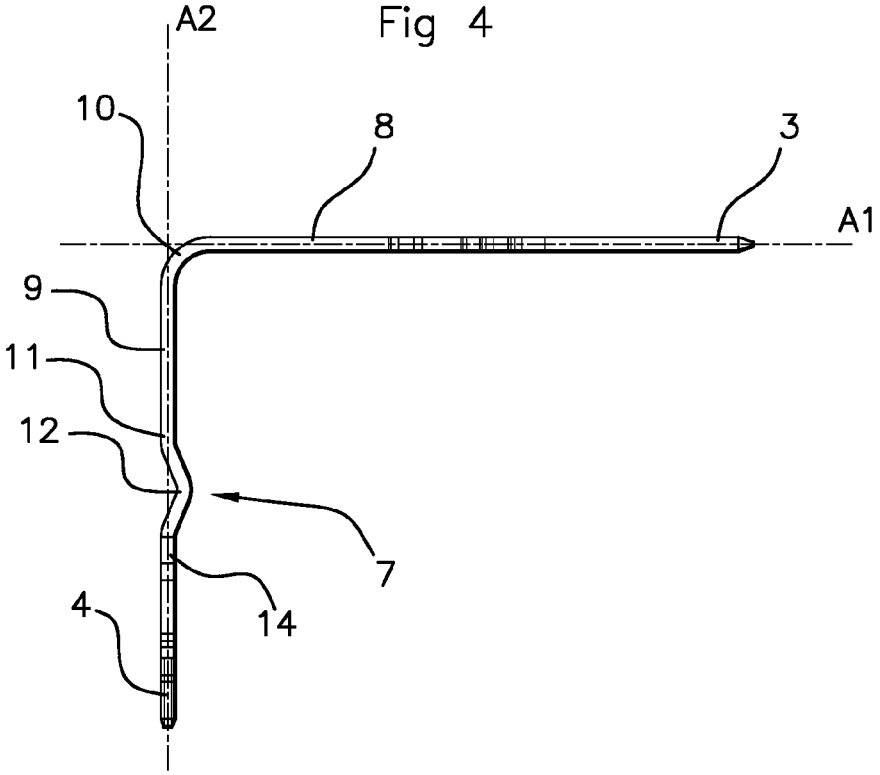
FIG. 4 represents a pin according to a second variant of the first embodiment of the invention.

According to a second variant of the first embodiment represented in FIG. 4, certain pins 2 comprise at least one wavy inflected part 7 at the level of their second straight portion 9.

According to this variant, the off-axis part 12 of the wavy inflected part 7 extends radially distant from the second axis A2.

The off-axis parts 12 at the level of a second straight portion 8 in their entirety preferably extend radially in the same direction, making it possible to prevent two wavy inflected parts 7 situated on adjacent pins 2 from coming into contact.

Figure 5:
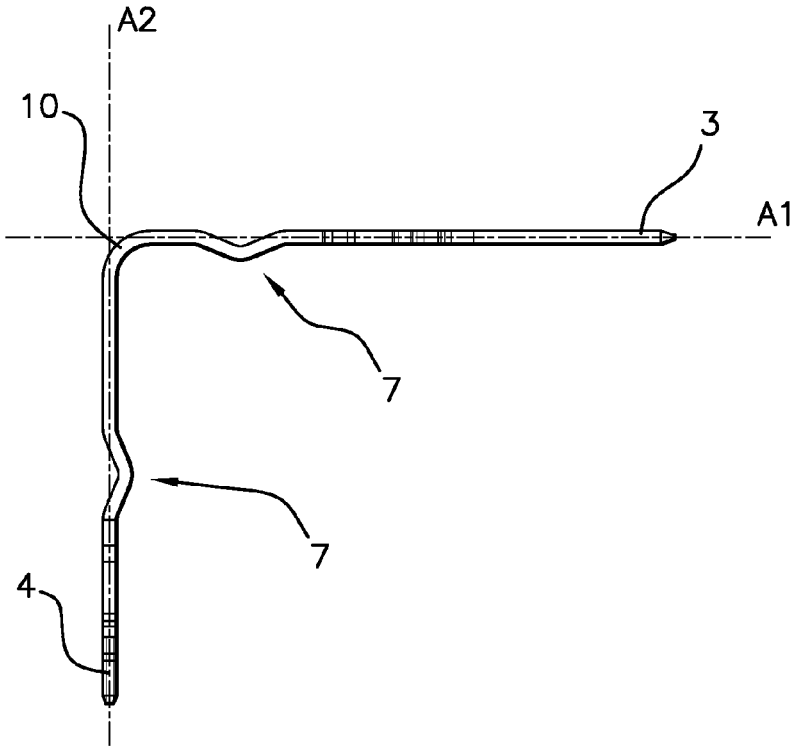
FIG. 5 represents a pin according to a third variant of the first embodiment of the invention.

Certain pins 2 may comprise both one wavy inflected part 7 at the level of their first straight portion 8 and one wavy inflected part 7 at the level of their second straight portion 9, as represented in FIG. 5.

According to another variant of the first embodiment, not represented here, certain pins 2 comprise at least one wavy inflected part 7 at the level of their bent portion 10.

According to this variant, the off-axis part 12 of the wavy inflected part 7 extends radially distant from the first axis A1, from the second axis A2 or from both of these simultaneously.

Preferably, and in order to simplify the manufacture of the connectors, the pins 2 comprising a single wavy inflected part 7 comprise one, two or three connectors.

In a second aspect, the invention also relates to a method for the manufacture of a connector.

The method according to the invention involves providing a plurality of pins 2.

As previously described, each pin 2 comprises a first end portion 3 and a second end portion 4.

The pins 2 are then secured to a casing 1 at the level of a securing portion 5, adjacent to the first end portion 3. The part of the pin 2 between the securing portion 5 and the second end portion 4 defines an insertion part 6.

The pins 2 are secured to the casing 1 in such a way that the insertion parts of the pins 2 preferably extend, in the first instance, in one and the same direction, referred to as the direction of connection.

Securing may take place by the insertion of the pins 2 under force into corresponding preformed holes in the casing 1 or by the molding of the casing 1 around the pins 2.

One or a number of wavy inflected parts 7 are subsequently realized on certain pins 2 at the level of their insertion part 6, thereby reducing the length of the pins 2 in the direction of insertion.

Figure 6:
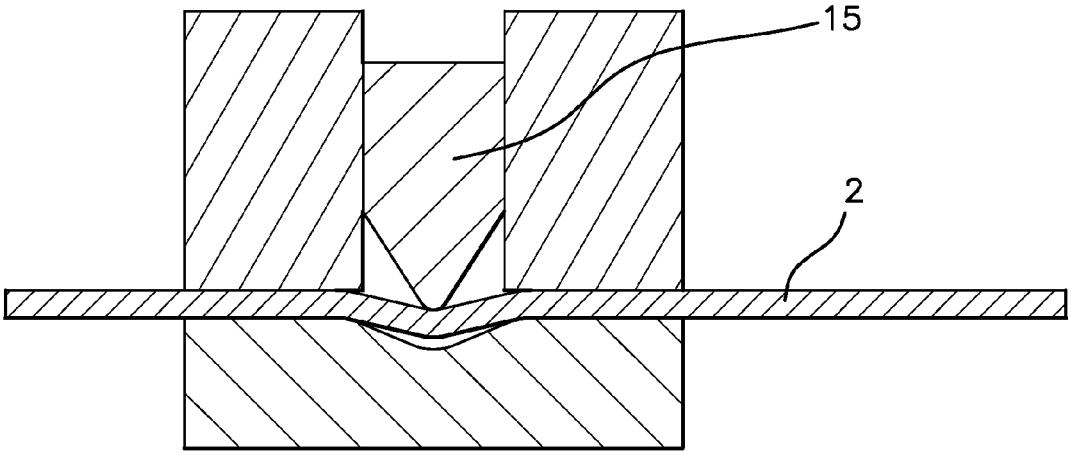
FIG. 6 is a schematic representation of the realization of the wavy inflected part.

As represented in FIG. 6, the realization of the wavy inflected part 7 may take place by the application of the pressure of a tool 15 on the insertion part 6 of the pin 2. The pressure of the tool is regulated as a function of the desired depth of the wavy inflected part 7.

The definition of the dimensions of the wavy inflected parts 7 may take place by adopting an empirical approach. It is possible, for example, to manufacture a first test connector comprising the same number and the same arrangement of the pins 2 and the same casing 1. For each pin 2, the differences in the lengths of the pins 2 are measured in relation to the desired length.

In fact, for manufacture with the same casing 1 and the same plurality of pins 2, the dispersion of the lengths of the pins 2 on their second axis A2 is due primarily to the deformation of the casing 1 and is reproducible. It is therefore easy, by means of a test connector, to estimate the dispersion of the lengths of the pins 2 on their second axis A2 and consequently by how much the length of the insertion part 6 of each pin 2 must be adjusted. Once the difference in length has been determined for each pin 2, a mathematical calculation will enable the dimensions of the wavy inflected part 7 to be determined.

On completion of the step of producing the wavy inflected parts 7, according to a preferred embodiment, the method in addition comprises a step which involves bending the pins 2 at the level of their insertion part 6 in a direction perpendicular to the direction of connection. A right-angle connector is obtained in this way.

The present invention has been described and illustrated in the present detailed description and in the figures. The present invention is not restricted to the embodiments presented here. Other variants and embodiments may be arrived at and implemented by a person skilled in the art by reading the present description and the accompanying figures.

In the claims, the expression "comprise" does not exclude other elements or other steps. The indefinite article "a" does not exclude the plural. The different characteristics presented and/or claimed may be combined advantageously. Their presence in the description or in different dependent claims does not exclude this possibility. The reference signs should not be regarded as limiting the scope of the invention.

The invention claimed is:

1. A connector comprising:

a casing; and a plurality of pins, each pin comprising:

a first end portion, extending along a first axis, a second end portion, extending along a second axis, a securing portion, adjacent to the first end portion and secured to the casing, an insertion part, arranged between the securing portion and the second end portion, wherein at least some of the pins comprise at the level of their insertion part at least one wavy inflected part, as a result of which the extremities of the second end portions of the pins are situated substantially in one and the same plane perpendicular to the second axis, the wavy inflected part comprises at least one axial part, extending along the first axis or the second axis and one off-axis part extending radially distant from the axial part, the off-axis part being connected to the axial part through a curved shape, and the insertion part of each pin comprises:

a first straight portion adjacent to the securing portion and extending essentially on the first axis, a second straight portion adjacent to the second end portion and extending essentially on the second axis, a bent portion, situated between the first and the second straight portion, the at least some of the pins comprising the at least one wavy inflected part at the level of their respective first straight portion.

2. The connector as claimed in claim 1, wherein the first axis is substantially perpendicular to the second axis.

3. The connector as claimed in claim 1, wherein the insertion part of each pin extends essentially on the second axis, the first axis and second axis being colinear.

4. A connector comprising:

a casing; and a plurality of pins, each pin comprising:

a first end portion, extending along a first axis, a second end portion, extending along a second axis, a securing portion, adjacent to the first end portion and secured to the casing, an insertion part, arranged between the securing portion and the second end portion, wherein at least some of the pins comprise at the level of their insertion part at least one wavy inflected part, as a result of which extremities of the second end portions of the pins are situated substantially in one and the same plane perpendicular to the second axis, the wavy inflected part comprises at least one axial part, extending along the first axis or the second axis and one off-axis part extending radially distant from the axial part, the off-axis part being connected to the axial part through a curved shape, and the insertion part of each pin comprises:

a first straight portion adjacent to the securing portion and extending essentially on the first axis, a second straight portion adjacent to the second end portion and extending essentially on the second axis, a bent portion, situated between the first and the second straight portion, the at least some of the pins including the at least one wavy inflected part at the level of their respective second straight portion.

5. A connector comprising:

a casing; and a plurality of pins, each pin comprising:

a first end portion, extending along a first axis, a second end portion, extending along a second axis, a securing portion, adjacent to the first end portion and secured to the casing, an insertion part, arranged between the securing portion and the second end portion, wherein at least some of the pins comprise at the level of their insertion part at least one wavy inflected part, as a result of which extremities of the second end portions of the pins are situated substantially in one and the same plane perpendicular to the second axis, the wavy inflected part comprises at least one axial part, extending along the first axis or the second axis and one off-axis part extending radially distant from the axial part, the off-axis part being connected to the axial part through a curved shape, and the insertion part of each pin comprises:

a first straight portion adjacent to the securing portion and extending essentially on the first axis, a second straight portion adjacent to the second end portion and extending essentially on the second axis, a bent portion, situated between the first and the second straight portion, the at least some of the pins including at least one wavy inflected part at the level of their respective bent portion.

* * * * *